US006267286B1

(12) United States Patent
Deschenes et al.

(10) Patent No.: US 6,267,286 B1
(45) **Date of Patent: *Jul. 31, 2001**

(54) FASTENER ATTACHING TOOL

(75) Inventors: Charles L. Deschenes, North Attleboro; Terence J. Jones, Bolton, both of MA (US); William J. Cooper, Woonsocket, RI (US)

(73) Assignee: Avery Dennison Corporation, Pasadena, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/859,582

(22) Filed: May 20, 1997

Related U.S. Application Data

(63) Continuation of application No. 08/523,417, filed on Sep. 5, 1995, now abandoned, which is a continuation of application No. 08/236,667, filed on May 2, 1994, now Pat. No. 5,495,974, which is a continuation of application No. 07/989,197, filed on Dec. 11, 1992, now abandoned.

(51) Int. Cl.[7] ..... A41H 37/10; B65C 7/00

(52) U.S. Cl. ..... 227/71; 227/67; 227/76

(58) Field of Search ..... 227/67, 68, 70, 227/71, 72, 75, 110, 119, 76; 112/104, 169

(56) References Cited

U.S. PATENT DOCUMENTS

| | | | | |
|---|---|---|---|---|
| Re. 29,819 | * | 10/1978 | Bone | 227/67 |
| 770,693 | * | 9/1904 | Nourse | 227/71 |
| 3,470,834 | * | 10/1969 | Bone | 227/67 X |
| 3,948,128 | * | 4/1976 | Russell | 227/76 X |
| 4,111,347 | * | 9/1978 | Bone | 227/68 |
| 4,179,063 | * | 12/1979 | Russell | 227/67 |
| 4,533,076 | * | 8/1985 | Bourque | 227/71 X |
| 4,611,740 | * | 9/1986 | Kunreuther | 227/67 |
| 4,877,172 | * | 10/1989 | Franklin et al. | 227/67 |
| 4,889,272 | * | 12/1989 | Kunreuther | 227/67 X |
| 5,020,713 | * | 6/1991 | Kunreuther | 227/67 |
| 5,033,664 | * | 7/1991 | Bone et al. | 227/67 |
| 5,205,458 | * | 4/1993 | Kunreuther | 227/67 X |
| 5,495,974 | * | 3/1996 | Deschenes et al. | 227/71 |

* cited by examiner

*Primary Examiner*—Clark F. Dexter
(74) *Attorney, Agent, or Firm*—Kriegsman & Kriegsman

(57) ABSTRACT

A fastener attaching tool particularly suited for use in attaching buttons to clothing, etc. and which is constructed for use with a fastener clip which includes a pair of runner bars and one or more U-shaped fasteners having transverse bars at opposite ends, each transverse bar being connected on its side to a corresponding runner bar by a severable connector post. The tool includes a pair of needles each having a longitudinal slotted bore adapted to receive one of the transverse bars and a knife edge formed on one side which is adapted to sever a connector post from its associated transverse bar as the transverse bar is pushed through the needle. The body includes a transverse feed slot disposed just to the rear of the needles down through which the fastener clip is manually inserted. The tool also includes an ejector mechanism, which is slidably mounted back and forth within the body and is rearwardly biased by a spring. The ejector mechanism is manually operable from the rear of the body and includes a pair of ejector rods which are slidable back and forth within the bores of the needles and are used to push the transverse bars into and through the needles.

7 Claims, 10 Drawing Sheets

FASTENER ATTACHING TOOL

This application is a continuation of application Ser. No. 08/523,417, filed on Sep. 5, 1995, now abandoned, which in turn is a continuation of application Ser. No. 08/236,667, filed on May 2, 1994, now U.S. Pat. No. 5,495,974, which in turn is a continuation of application Ser. No. 07/989,197, filed on Dec. 11, 1992, now abandoned.

BACKGROUND OF THE INVENTION

The present invention relates to a new and novel fastener attaching tool particularly suited for use in consumer applications such as to recouple detached buttons to clothing, etc.

The conventional method of coupling or recoupling buttons to garments or fabrics, either by machine or by hand, is with thread. The button is held in place and a needle containing thread is inserted through each of two, three or more holes in the button and into the material several times until sufficient strands of thread exist to securely hold the button to the material. The thread must then be tied or otherwise fastened so that it will not unravel. In some instances, where it is desired to elevate the button from the material, a pedestal effect is achieved by laterally wrapping the strands with additional thread. The disadvantages to this method of securing buttons to fabric or garments are several. First of all, it is a slow and tedious job and the button can soon become detached if only one of the threads is severed or if the ends of the thread are not secured properly.

In the commonly assigned U.S. Pat. Nos. 3,399,432, 3,470,834, and 3,494,004, all of which are incorporated herein by reference, there is described a plastic fastener which may be used instead of thread to couple or to recouple a button to an article of clothing. The fastener typically comprises a flexible filament having a head at one end and a transverse bar at the opposite end. A plurality of such fasteners are typically manufactured as part of a clip in which the fasteners are interconnected in a row to a stringer or runner bar connected to the transverse bars of the fasteners by corresponding necks or connector posts. To sever an individual fastener from the fastener clip and to attach the severed fastener to a desired article (e.g., through a button hole and into an article of clothing), a fastener attaching device is typically used. Such a device typically comprises a casing, a needle projecting from the casing, the needle and the casing having longitudinal bores in alignment with each other, a plunger slidable back and forth within said bores, a handle telescoping over the rear of the casing for sliding said plunger within said bores, and means comprising an indexing wheel for feeding fasteners into the device successively with the transverse bars in alignment with said bores ahead of the plunger so that they may be projected through the needle by reciprocating the plunger. Typically, the rear end of the needle is shaped to define a knife edge so that insertion of the transverse bar into the longitudinal bore of the needle using the plunger causes the knife edge of the needle to sever the connector post connecting the fastener to the remainder of the fastener clip.

While the above-described fasteners have been found to be generally satisfactory for attaching buttons to certain articles of clothing, they have not found universal application for the following reasons: First, when placed in direct contact with a person's skin, the transverse bar of the fastener has a tendency to be irritating. This is in part because the above-described severing of the connector post often leaves a burr on the bottom of the transverse bar and is in part because of the somewhat sharp ends and large size of the transverse bar. Second, the fasteners are often too big to be used with many buttons and, therefore, require the use of specially designed buttons having large holes. Third, the fasteners tend to be conspicuous in appearance due to the fact that a separate fastener is used for every button hole, as opposed to being looped between two or more button holes in the same way that thread typically is.

SUMMARY OF THE INVENTION

It is an object of the present invention to provide a new and novel fastener attaching tool particularly suited for use in consumer applications such as to recouple detached buttons to clothing, etc.

It is another object of the present invention to provide a fastener attaching tool as described above which is adapted for use with a new and novel fastener clip, the fastener clip preferably comprising a pair of generally parallel runner bars and one or more fasteners, each fastener comprising a U-shaped filament and a pair of generally parallel transverse bars disposed at opposite ends thereof, the U-shaped filament being disposed in the plane of the pair of generally parallel runner bars and aligned with the longitudinal axes thereof, each of the pair of transverse bars being connected to a corresponding runner bar by a connector post, the connector posts being severably connected to the outer sides of their respective transverse bars.

It is still another object of the present invention to provide a fastener attaching tool as described above which lends itself to construction using moldable parts and thus may be mass-produced relatively inexpensively.

Additional objects, features, and advantages of the present invention will be set forth in part in the description which follows, and in part will be obvious from the description or may be learned by practice of the invention. The objects, features and advantages of the invention may be realized and attained by means of the instrumentalities and combinations particularly pointed out in the appended claims.

In a preferred embodiment of the invention, the fastener attaching tool comprises a body, a needle block, a pair of needles, a spring, and an ejector mechanism.

Each of the pair of needles includes a longitudinally extending slotted bore adapted to receive one of the transverse bars of the fastener, with the adjacent end of the filament extending through the slot in the bore. The needles are mounted in a parallel arrangement in the needle block which, in turn, is removably mounted in a cavity formed in the front end of the body. Each needle has a knife edge formed on its outer side which is adapted to sever a connector post from its associated transverse bar as the transverse bar is pushed by it.

The body is also shaped to include a transverse feed slot disposed just to the rear of the needles down through which the above-described fastener clip is manually inserted. To assist in properly aligning the fastener clip within the feed slot so that the transverse bars of a desired fastener are aligned with the longitudinal bores of the needles, the inner walls of the slot are shaped to include a pair of feed bars which engage corresponding indentations formed on the outer sides of the fastener clip.

The ejector mechanism, which is slidably mounted back and forth within the body and is rearwardly biased by the spring, is manually operable from the rear of the body. Actuation of the ejector mechanism is preferably achieved using one's thumb, and the body is provided with a pair of finger openings so that the device may be held and used like a syringe. The ejector mechanism includes a pair of ejector rods which are slidable back and forth within the longitudinal bores of the needles and are used both to load the transverse bars of the aligned fastener into the longitudinal bores of the needles and to push the transverse bars therethrough into a desired article.

BRIEF DESCRIPTION OF THE DRAWINGS

The accompanying drawings, which are hereby incorporated in and constitute a part of this specification, illustrate the preferred embodiments of the invention and, together with the description, serve to explain the principles of the invention. In the drawings, wherein like reference numerals represent like parts.

DETAILED DESCRIPTION OF PREFERRED EMBODIMENTS

Figure 1:
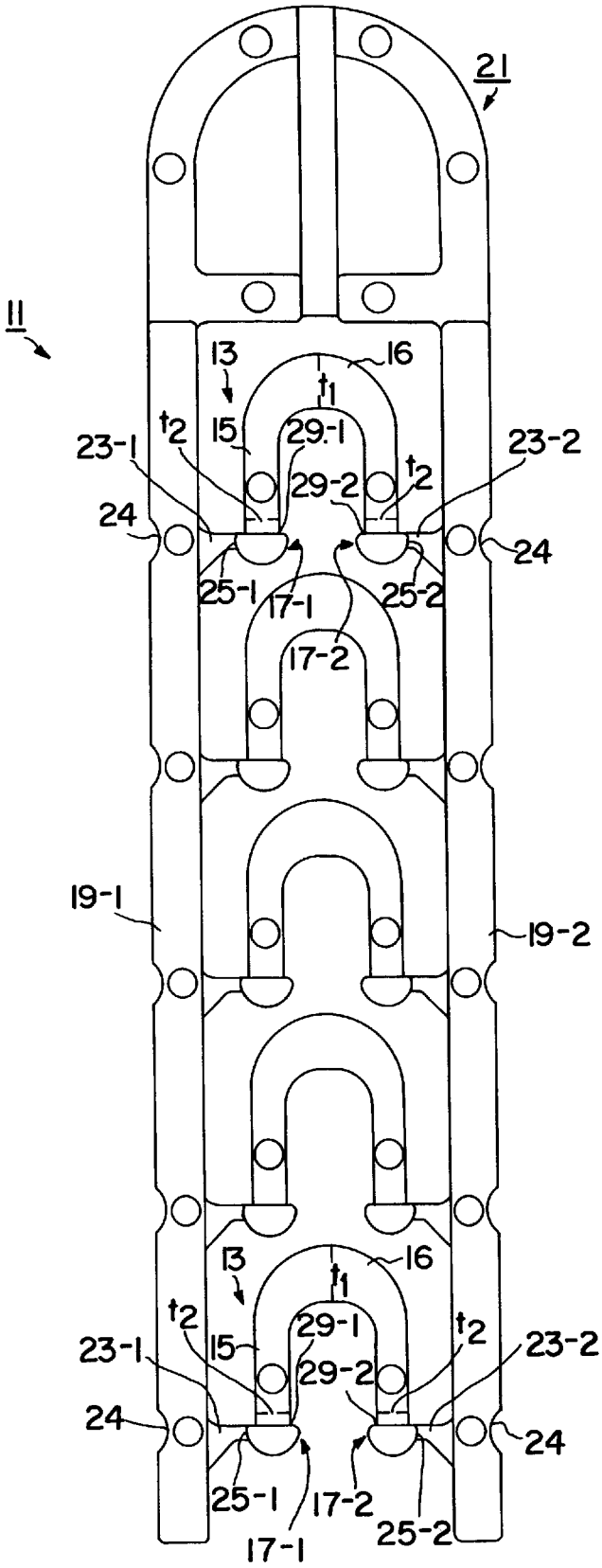
FIG. 1 is a front view of one embodiment of a fastener clip constructed according to the teachings of the present invention.
Figure 2:
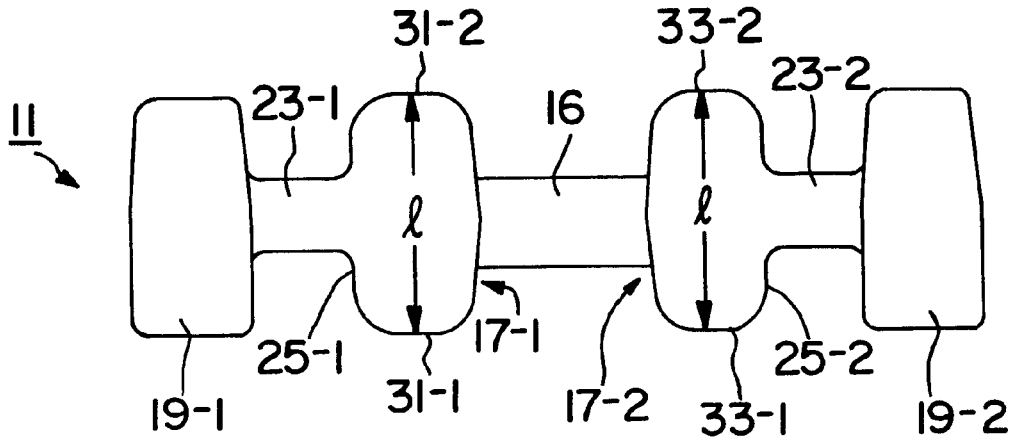
FIG. 2 is a bottom view of the fastener clip shown in FIG. 1.

Referring to the drawings and in particular to FIGS. 1 and 2, there are shown front and bottom views, respectively, of a fastener clip constructed according to the teachings of the present invention, the fastener clip being represented generally by reference numeral 11.

Clip 11 is a unitary structure preferably molded from polyurethane or similar materials. Clip 11 comprises five identical fasteners 13, the number of fasteners being illustrative only. Each fastener 13 includes a flexible U-shaped filament 15 and a pair of transverse bars or feet 17-1 and 17-2 disposed at opposite ends thereof. To maximize the strength of the fastener, filament 15 is preferably rectangular in cross-section and has a non-uniform thickness, i.e., the arcuate region 16 has a thickness $t_1$ greater than the thickness $t_2$ at the ends. Feet 17-1 and 17-2 are appropriately dimensioned so that they may be inserted into a desired garment through a pair of button holes of conventional size and thereafter be retained by the underside of the garment.

Clip 11 also comprises a pair of runner bars 19-1 and 19-2, the top ends of which are joined to form a handle 21. The outer edges of runner bars 19-1 and 19-2 are provided with indentations 24 which, as will be seen below, assist in properly feeding clip 11 into a fastener attaching tool.

Each fastener 13 is connected to runner bars 19-1 and 19-2 by severable connector posts 23-1 and 23-2, respectively. For reasons to be discussed below, connector posts 23-1 and 23-2 are connected to the outer sides 25-1 and 25-2 of feet 17-1 and 17-2, respectively.

Figure 3:
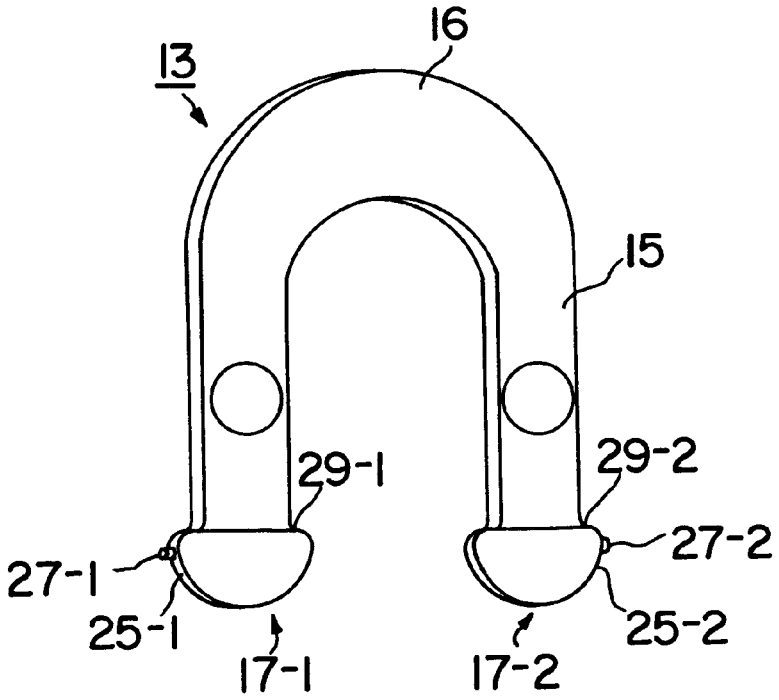
FIG. 3 is an enlarged front perspective view of one of the fasteners shown in FIG. 1 after it has been separated from the remainder of the fastener clip.

In order that fastener 13 may be used with garments in which feet 17-1 and 17-2 may be placed in direct contact with a person's skin, fastener clip 11 includes the following features which are designed to minimize irritation of a person's skin. First, as noted above, connector posts 23-1 and 23-2 are connected to the outer sides 25-1 and 25-2 of feet 17-1 and 17-2. In this manner, when posts 23-1 and 23-2 are severed, burrs 27-1 and 27-2 (see FIG. 3) are left on outer sides 25-1 and 25-2, where they are not as likely to come into contact with a person's skin as they would be if they were left on the bottom surface of feet 17-1 and 17-2. Second, feet 17-1 and 17-2 have a length l which is comparatively small, i.e., approximately 2 mm as compared to 6 mm for the transverse bars of existing like fasteners, and an overall size that is comparable to that of a knot of a thread used to secure a button to a piece of fabric. Consequently, feet 17-1 and 17-2 have relatively little surface area which may come into contact with a person's skin. Third, the top surfaces 29-1 and 29-2 of feet 17-1 and 17-2, respectively, are generally flat to give feet 17-1 and 17-2 a low profile and to keep feet 17-1 and 17-2 from rocking relative to the underside of a garment to which fastener 13 has been attached (see FIG. 13). Fourth, feet 17-1 and 17-2 have rounded ends 31-1/31-2 and 33-1/33-2, respectively.

To use fastener 13 to couple a button to a garment, an individual fastener 13 is first detached from fastener clip 11 by severing connector posts 23-1 and 23-2. Feet 17-1 and 17-2 of the severed fastener 13 are then inserted first through a corresponding pair of button holes and then through the desired garment. Both the severing and inserting steps may be done manually or with the aid of an appropriate fastener attaching tool.

Figure 4:
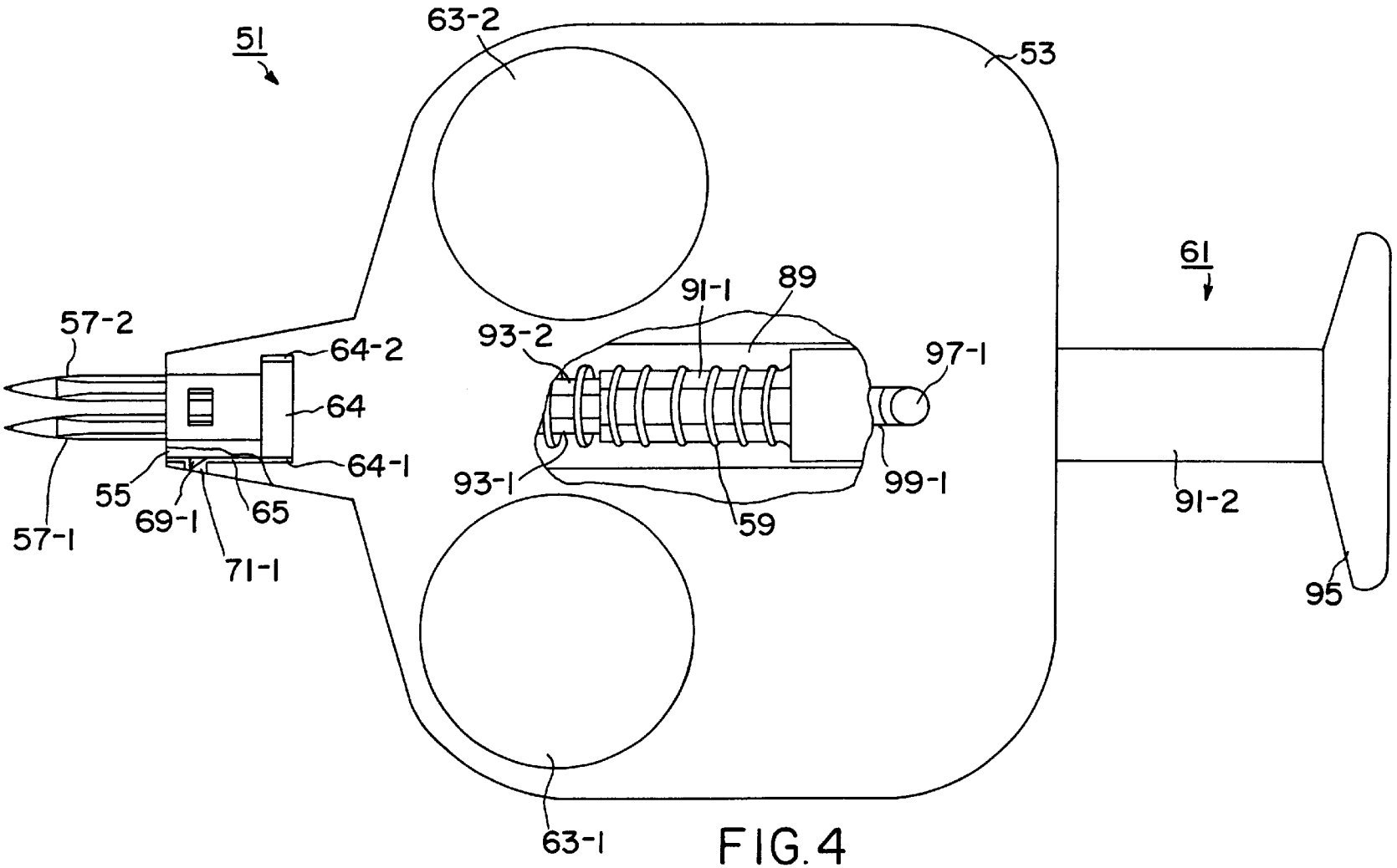
FIG. 4 is a top view of one embodiment of a fastener attaching device constructed according to the teachings of the present invention for attaching an individual fastener from the fastener clip of FIG. 1 to a garment through a pair of button holes in such a way as to attach the button to the garment.
Figure 5:
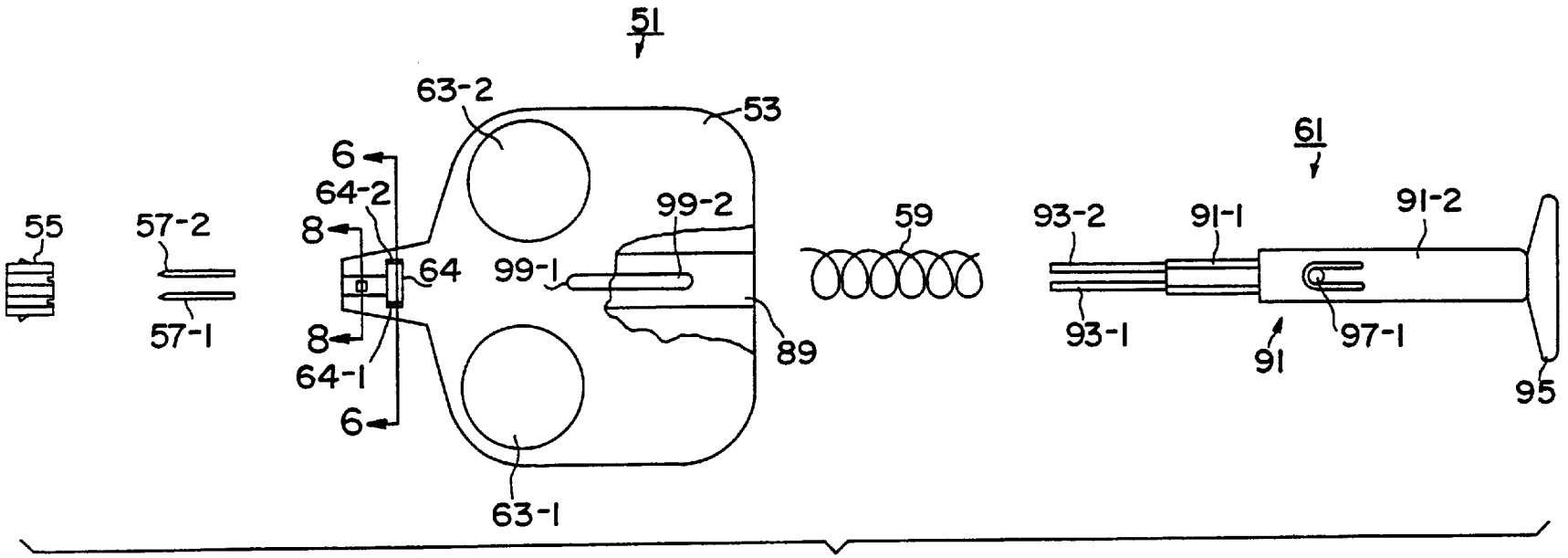
FIG. 5 is a partially exploded top view of the fastener attaching device shown in FIG. 4 with the body being broken away in part.

Referring now to FIGS. 4 and 5, there is shown one embodiment of a fastener attaching tool suitable for use with fastener clip 11 in the above-described manner, the fastener attaching tool being represented generally by reference numeral 51.

Tool 51 includes a body 53, a needle block 55, a pair of needles 57-1 and 57-2, a spring 59, and an ejector mechanism 61.

Figure 6:
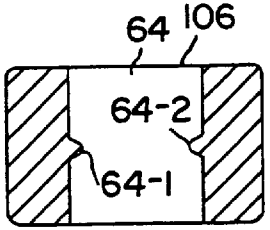
FIG. 6 is a section view of the body shown in FIG. 5 taken along line 6—6.
Figure 7A:
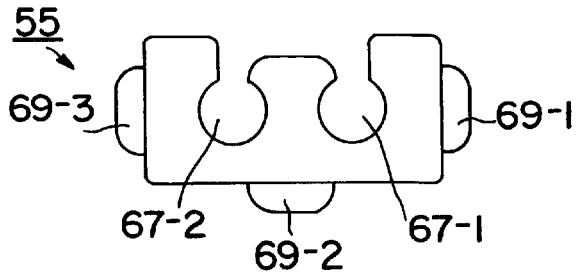
FIGS. 7(*a*) through 7(*d*) are front, rear, top and right side views, respectively, of the needle block shown in FIG. 5.
Figure 7B:
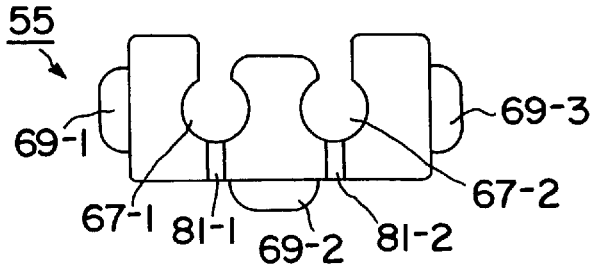
Figure 7C:
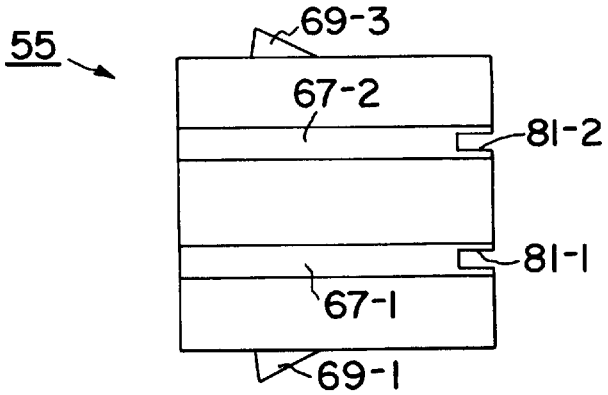
Figure 7D:
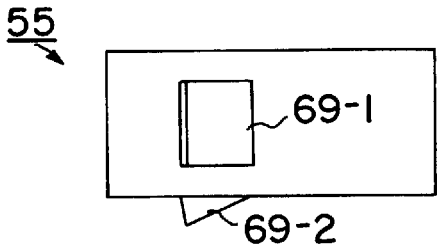

Body 53 is a unitary structure preferably molded from a lightweight durable plastic. Body 53 is shaped to define a pair of transverse openings 63-1 and 63-2 which are provided so that a user may operate tool 51 like a syringe by placing the index and middle fingers through openings 63-1 and 63-2 while actuating ejector mechanism 61 with the thumb. Body 53 is also provided with a transversely extending feed slot 64 down through which fastener clip 11 may be inserted in a direction perpendicular to the longitudinal axis of body 53. As can be seen best in FIG. 6, slot 64 is shaped to include a pair of feed bars 64-1 and 64-2 which, as will be discussed below in greater detail, are used to engage indentations 24 on runner bars 19-1 and 19-2, respectively, to properly align fastener clip 11 within tool 51.

Figure 8:
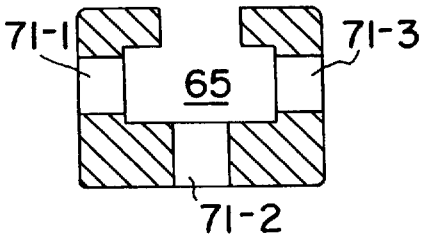
FIG. 8 is a section view of the body shown in FIG. 5 taken along line 8—8.
Figure 9A:
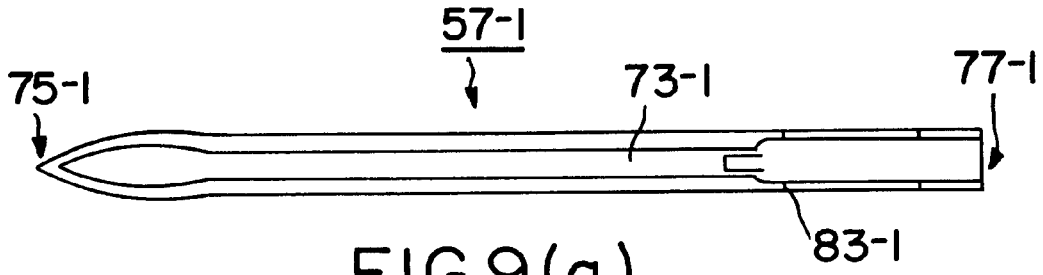
FIGS. 9(*a*) through 9(*d*) are top, right side, left side and rear views, respectively, of one of the needles shown in FIG. 5.
Figure 9B:
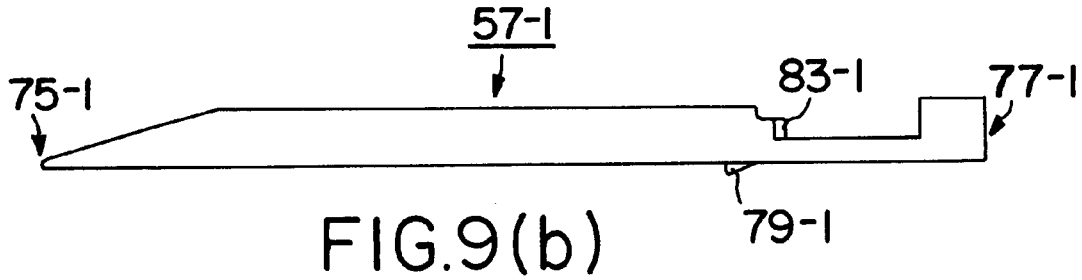
Figure 9C:
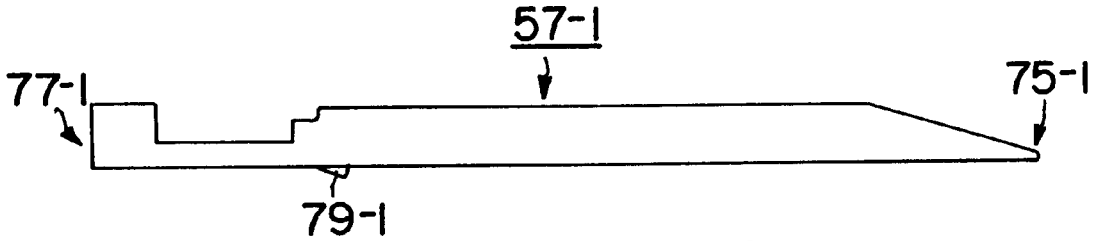
Figure 9D:
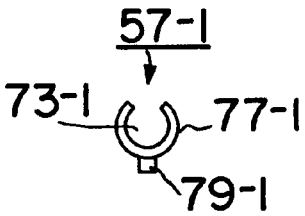

Needle block 55, which is removably mounted in a cavity 65 formed in body 53 and accessible from the front end thereof, is shown in greater detail in FIGS. 7(*a*) through 7(*d*). As can be seen therein, block 55 is generally rectangular unitary structure having a pair of generally cylindrically shaped grooves 67-1 and 67-2 adapted to receive needles 57-1 and 57-2, respectively. Block 55 is retained within opening 65 by means of a plurality of outwardly biasing tabs 69-1 through 69-3 which snap into place in corresponding slots 71-1 through 71-3 (see FIG. 8) in cavity 65.

Block 55 is also preferably molded from a lightweight durable plastic.

Needle 57-1, which is a mirror image of needle 57-2 reflected along its longitudinal axis, is shown in greater detail in FIGS. 9(*a*) through 9(*d*). As can be seen therein, needle 57-1 is a unitary structure shaped to include a generally cylindrical slotted bore 73-1. Bore 73-1 has a cross-sectional diameter slightly larger than that of foot 17-1 of fastener 13. The forward end 75-1 of needle 57-1 is pointed to permit its insertion through garments and button holes of conventional size. The rearward end 77-1 of needle 57-1 is open and is appropriately dimensioned to permit foot 17-1 to be loaded into bore 73-1 with the adjacent end of filament 15 extending through the slot of bore 73-1. Needle 57-1 is retained within groove 67-1 of block 55 by means of a downwardly-angled fin 79-1 which engages a corresponding slot 81-1 in groove 67-1 (see FIGS. 7(*b*) and 7(*c*)).

The left side of needle 57-1 (viewing needle 57-1 from its rearward end 77-1 as opposed to its forward end 75-1) is shaped to define a knife 83-1. As will be described below in greater detail, knife 83-1 is used to sever the connecting post 23-1 connecting a desired fastener 13 to runner bar 19-1. (A corresponding knife edge formed on the right side of needle 57-2 is similarly used to sever the connecting post 23-2 connecting the same fastener to runner bar 19-2.)

Needles 57-1 and 57-2 are preferably cut and stamped from sheet metal.

Figure 10A:
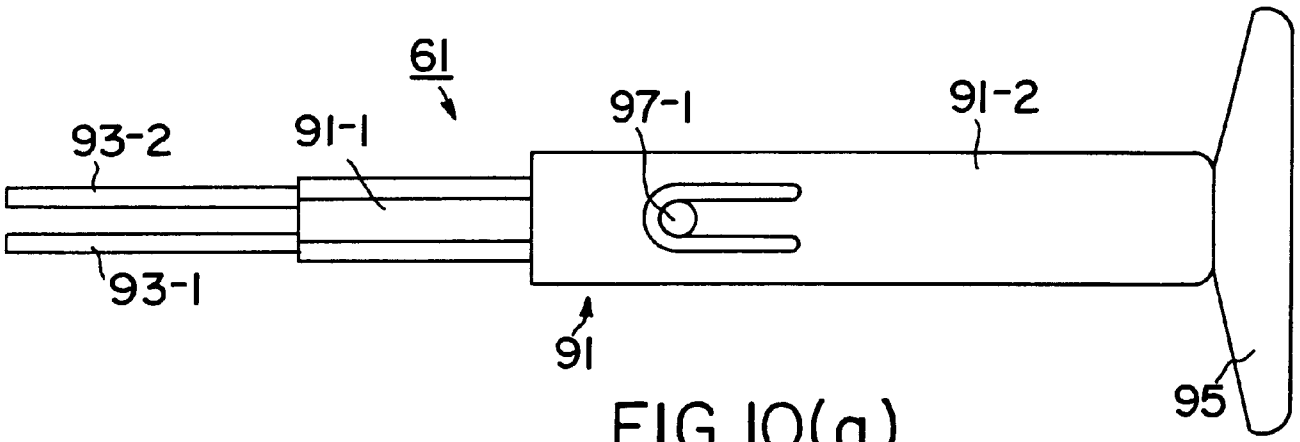
FIGS. 10(*a*) and 10(*b*) are bottom and right side views, respectively, of the ejector mechanism shown in FIG. 5.
Figure 10B:
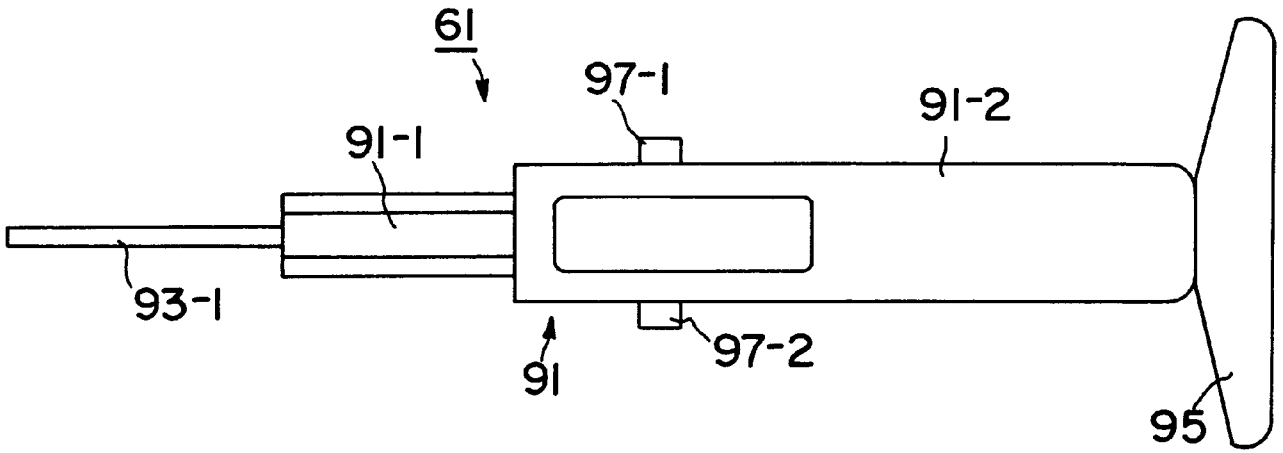

Ejector mechanism 61, which is shown in greater detail in FIGS. 10(*a*) and 10(*b*), is slidably mounted within a longitudinally extending channel 89 formed in body 53 and accessible from the rear end thereof. As can be seen therein, mechanism 61 comprises an elongated generally rectangular ejector block 91 having a front portion 91-1 of comparatively smaller cross-section and a rear portion 91-2 of comparatively larger cross-section. A pair of ejector rods 93-1 and 93-2 are fixedly mounted on the forward end of front portion 91-1. As will hereinafter be described in greater detail, ejector rods 93-1 and 93-2 are appropriately dimensioned and properly positioned so that, as ejector block 91 moves through channel 89, the front ends of ejector rods 93-1 and 93-2 cause feet 17-1 and 17-2 of a fastener 13 which is properly disposed within slot 64 to be loaded onto needles 57-1 and 57-2 and thereafter to be ejected therefrom. A disc-shaped base 95 is fixedly mounted on the rearward end of rear portion 91-2 to facilitate manipulation of mechanism 61.

Ejector rods 93-1 and 93-2 are preferably made of metal, and the remainder of ejector mechanism 61 is preferably molded from lightweight durable plastic.

Lightweight movement of mechanism 61 within channel 89 is restricted by base 95 and by a pair of integrally formed posts 97-1 and 97-2 disposed on the top and bottom surfaces, respectively, of rear portion 91-2 which travel in corresponding guide slots 99-1 and 99-2 (see FIG. 5) formed in body 53. Posts 97-1 and 97-2 are made to be depressable inwardly to permit insertion of block 91 into channel 89. Spring 59, which engages the front of channel 89 at one end and the forward end of rear portion 91-2 at the opposite end, biases ejector mechanism 61 towards the rear of channel 89.

Figure 11:
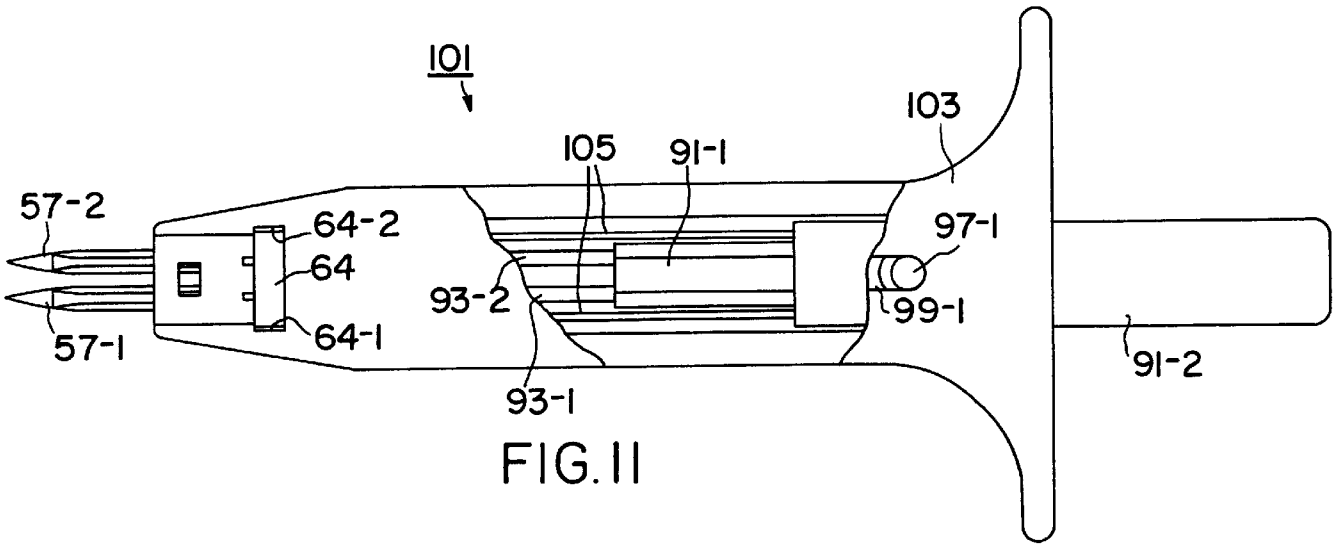
FIG. 11 is a top view, broken away in part, of a second embodiment of a fastener attaching device constructed according to the teachings of the present invention for attaching an individual fastener from the fastener clip of FIG. 1 to a garment through a pair of button holes in such a way as to attach the button to the garment.

A fastener dispensing tool similar in construction to tool 51 is shown in FIG. 11, the tool being represented generally by reference numeral 101. The differences between tool 101 and tool 51 are few, the principal differences being the shape of body 103, the lack of a base 95 in tool 101, and the construction of spring 105. Tool 101 is operated in the same way as tool 51.

In use, a desired fastener clip 11 is loaded into tool 51 by grasping handle 21 and pushing the clip down through inlet 106 slot 64 until the indentations 24 on runner bars 19-1 and 19-2 corresponding to a desired fastener 13 are engaged by bars 64-1 and 64-2. With this done, feet 17-1 and 17-2 of the desired fastener 13 are positioned behind needles 57-1 and 57-2, respectively, and are in alignment with their corresponding bores 73-1 and 73-2.

To attach a button to a piece of fabric using the fastener loaded in the above manner, the tips 75-1 and 75-2 of needles 57-1 and 57-2, respectively, are inserted first through a pair of holes in the button and then through the piece of fabric. Ejector mechanism 61 is then advanced through channel 89 towards the front of body 53. The initial advancement of ejector mechanism 61 causes ejector rods 93-1 and 93-2 to push feet 17-1 and 17-2 of the desired fastener 13 into bores 73-1 and 73-2. As the advancement of ejector mechanism 61 continues, ejector rods 93-1 and 93-2 push feet 17-1 and 17-2 past knife edges 83-1 and 83-2 of needles 57-1 and 57-2, causing connector posts 23-1 and 23-2 to be severed thereby. Finally, as the advancement of ejector mechanism 61 terminates, ejector rods 93-1 and 93-2 cause feet 17-1 and 17-2 to be ejected from the front ends of needles 57-1 and 57-2. Ejector mechanism 61 is then allowed to retract and needles 57-1 and 57-2 are withdrawn.

Figure 12:
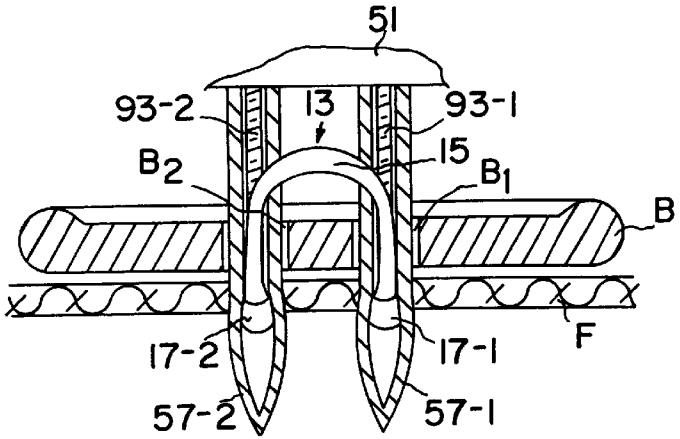
FIG. 12 is an enlarged section view of the front end of the fastener attaching device of FIG. 4 shown with the pair of ejector rods in an advanced position to illustrate how one of the fasteners shown in FIG. 1 may be inserted through a pair of button holes and secured to a garment.

FIG. 12 shows a fastener 13 being inserted through a pair of button holes $\mathbf{8}_1$ and $\mathbf{8}_2$ and into a piece of fabric F using tool 51.

Figure 13:
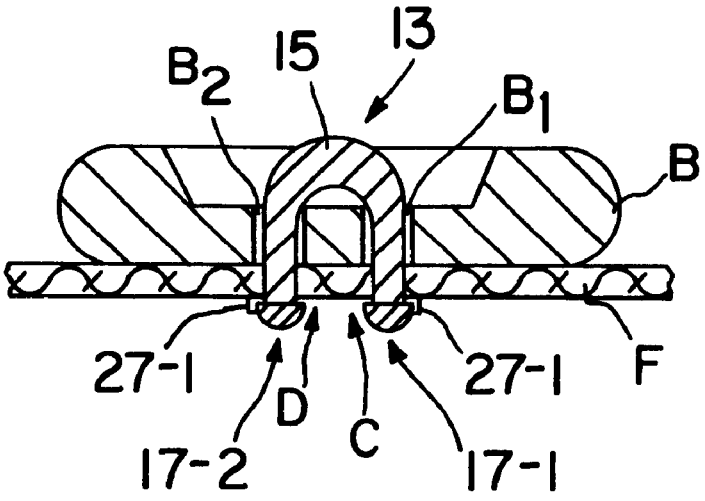
FIG. 13 is an enlarged section view similar to FIG. 12 but after the fastener attaching device has been removed showing how one of the fasteners shown in FIG. 1 is used to attach a button to a garment.
Figure 14:
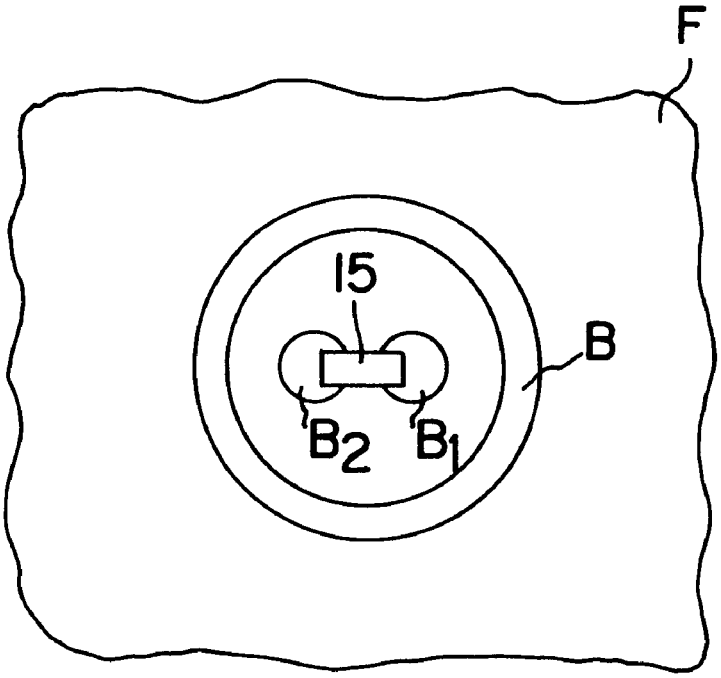
FIG. 14 is a top view of the combination of the button, garment and fastener shown in FIG. 13.

Referring now to FIGS. 13 and 14, there are shown section and top views, respectively, of a button 8 which has been coupled to a piece of fabric F using fastener 13. As seen best in FIG. 13, the advantages resulting from gating fastener 13 to runner bars 19-1 and 19-2 on the outer sides of feet 17-1 and 17-2 are substantial as burrs 27-1 and 27-2 are not left on the bottoms of feet 17-1 and 17-2 where they are most likely to irritate a person's skin. The consequences of making the top surfaces of feet 17-1 and 17-2 flat, as opposed to curved, to give feet 17-1 and 17-2 a low profile and to keep feet 17-1 and 17-2 from rocking in the directions indicated by arrows C and D can also be seen in FIG. 13. As seen best in FIG. 14, another benefit to fastener 13 is that, by having filament 15 extend between button holes $\mathbf{8}_1$ and $\mathbf{8}_2$ in a looped fashion, it creates the appearance that thread, as opposed to a plastic fastener, is being used to secure the button to the fabric.

Figure 16:
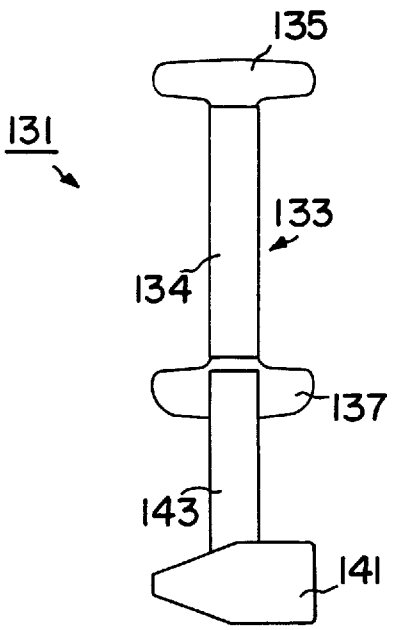
FIG. 16 is a left side view of the fastener clip shown in FIG. 15.
Figure 15:
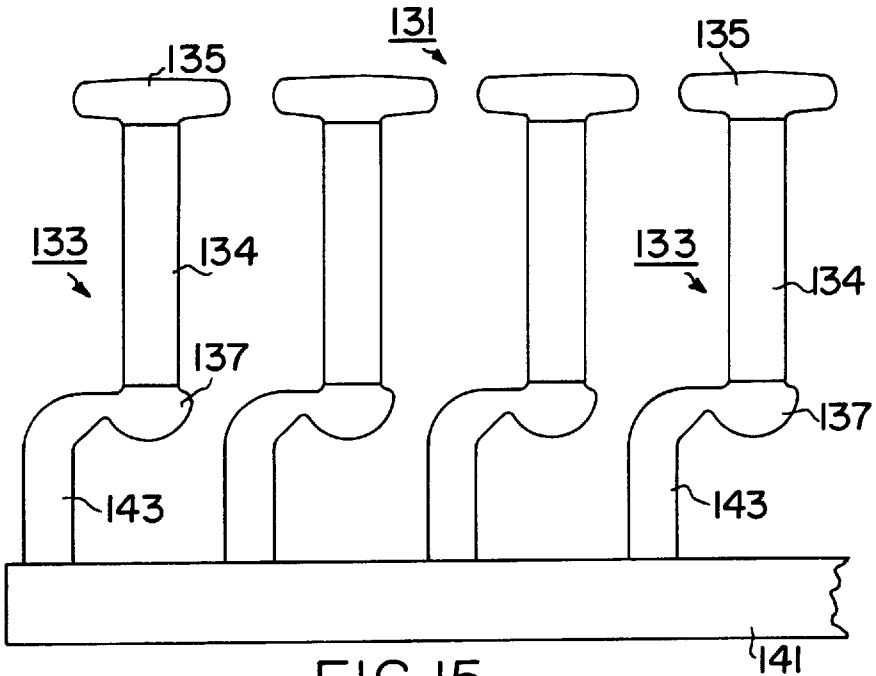
FIG. 15 is a fragmentary front view of a second embodiment of a fastener clip constucted according to the teachings of the present invention.
Figure 17:
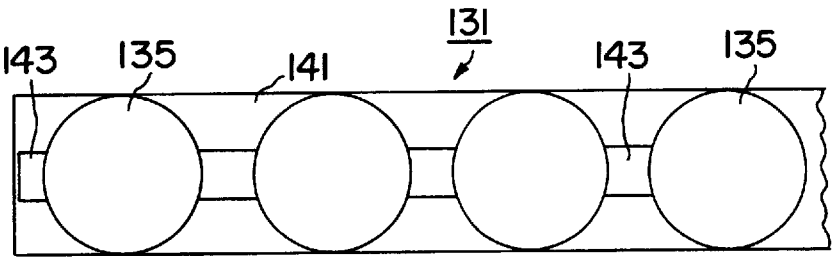
FIG. 17 is a top view of the fastener clip shown in FIG. 15.

Referring now to FIGS. 15 through 17, there are shown various views of a second embodiment of a fastener clip constructed according to the teachings of the present invention, the fastener clip being represented generally by reference numeral 131.

Fastener clip 131 includes a plurality of identical fasteners 133, each fastener 133 including a flexible filament 134 having a head 135 at one end and a foot 137 at the opposite end. Foot 137 is similar in size and shape to feet 17-1 and 17-2 of fastener 13. Fastener clip 131 also includes a runner bar 141 which is severably connected to fasteners 133 by connector posts 143, each connector post 143 being connected to the side of its corresponding foot 137.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A tool for dispensing individual fasteners from a fastener clip into a desired article, the fastener clip comprising a pair of generally parallel runner bars and one or more fasteners, each fastener comprising a flexible filament and a pair of transverse bars disposed at opposite ends thereof, each of the pair of transverse bars having an outer side and being connected to a corresponding runner bar by a connector post, the connector posts being severably connected to the outer sides of their respective transverse bars, said tool comprising:

a) a body, said body having a front;

b) a pair of needles projecting from the front of the body, each of said needles having a front end remote from said body which is adapted for insertion into the article, a longitudinally extending bore in each of said needles, said longitudinally extending bore being appropriately dimensioned to permit on of the transverse bars of the fastener to slide therethrough, an outer side on each of said needles, a longitudinal slot in each of said needles, said longitudinal slot communicating with said longitudinally extending bore to permit the end of the filament adjacent to the transverse bar to extend therethrough, and a knife edge integrally formed on the outer side of each of said needles to cut the connector post as the transverse bar passes by, said pair of needles being oriented relative to one another so that said longitudinal slots face in the same direction; and c) a pair of ejector rods slidable back and forth through said needles for pushing the transverse bars of the fastener through said longitudinally extending bores of said needles and into the desire article.

2. The fastener attaching tool as claimed in claim 1 wherein said body also has a rear, said rear being provided with an opening, said fastener attaching tool further comprising an ejector block, said ejector block having a front end and a rear end, said ejector rods being mounted on the front end of said ejector block, said rear end of said ejector block extending through said opening in the rear of said body.

3. A tool for dispensing individual fasteners from a fastener clip into a desired article, the fastener clip comprising a pair of generally parallel runner bars and one or more fasteners, each fastener comprising an elongated flexible filament and a pair of transverse bars, one transverse bar being disposed at each end of said elongated flexible filament, each of the pair of transverse bars being connected to a corresponding runner bar by a connector post, the connector posts being severably connected to outer sides of their respective transverse bars, said tool comprising:

a) a body having a front end, a top, a rear end and a channel, said rear end having an opening, said channel extending inward from said opening;

b) a pair of needles projecting from the front end of the body, each of said needles having a front end which is adapted for insertion into the article, a side, a longitudinally extending bore appropriately dimensioned to permit one of the transverse bars of the fastener to slide therethrough, a knife edge and a longitudinal slot, said longitudinal slot communicating with said longitudinally extending bore to permit the end of the filament adjacent to the transverse bar to extend therethrough, said knife edge being on the side of said needle spaced from said front end to cut the connector post as the transverse bar passes by, said pair of needles being oriented relative to one another so that said longitudinal slots face in the same direction; and c) an ejector mechanism slidably mounted in said channel and manually movable back and forth in said channel through the opening in the rear end of said body, said ejector mechanism including a pair of ejector rods insertable into said longitudinally extending bores of said needles for pushing the transverse bars of the fastener through said longitudinally extending bores of said needles and into the desired article.

4. A tool for dispensing individual fasteners from a fastener clip into a desired article, the fastener clip comprising a pair of generally parallel runner bars and one or more fasteners disposed between said generally parallel runner bars and severably connected thereto, each fastener comprising a flexible filament and a pair of transverse bars disposed at opposite ends thereof, said tool comprising:

a) a body, said body having a front end, a rear end, a top and a bottom, said front end being provided with an opening, said body also having a transverse feed slot;

b) a needle block, said needle block being removably mounted in said opening in said front end of said body;

c) a pair of needles mounted in said needle block and projecting out from the front end of the body, each of said needles having a front end remote from said body which is adapted for insertion into the article, a longitudinally extending bore in each of said needles, said longitudinally extending bore being appropriately dimensioned to permit one of the transverse bars of the fastener to slide therethrough, a longitudinal slot in each of said needles, said longitudinal slot communicating with said longitudinally extending bore to permit the end of the filament adjacent to the transverse bar to extend therethrough, wherein the needles are oriented relative to one another so that said longitudinal slots face in the same direction;

d) said transverse feed slot extending from said top of said body downwardly through said bottom of said body so that said generally parallel runner bars of said clip can be manually inserted down through said transverse feed slot; and e) a pair of ejector rods slidable back and forth through said needles for pushing the transverse bars of the fastener through said longitudinally extending bores of said needles and into the desired article.

5. The tool as claimed in claim 4 wherein each of said needles has an outer side and a knife edge integrally formed on said outer side.

6. A tool for dispensing individual fasteners from a fastener clip into a desired article, the fastener clip comprising one or more fasteners, each fastener comprising a flexible filament and a pair of transverse bars disposed at opposite ends thereof, said tool comprising:

a) a body, said body having a front end, a rear end, a top and a bottom, said body also having a feed slot, said feed slot extending downwardly from said top of said body;

b) a pair of needles projecting out from the front end of the body, each of said needles having a front end remote from said body which is adapted for insertion into the article, a longitudinally extending bore in each of said needles, said longitudinally extending bore being appropriately dimensioned to permit one of the transverse bars of the fastener to slide therethrough, a longitudinal slot in each of said needles, said longitudinal slot communicating with said longitudinally extending bore to permit the end of the filament adjacent to the transverse bar to extend therethrough, said needles being oriented relative to one another so that said longitudinal slots face in the same direction, wherein said direction is upwardly towards the top of said body; and c) a pair of ejector rods slidable back and forth through said needles for pushing the transverse bars of the fastener through said longitudinally extending bores of said needles and into the desired article.

7. The tool as claimed in claim 6 wherein each of said needles has an outer side and a knife edge integrally formed on said outer side.

* * * * *